343-754 SR
9/12/78 OR 4,114,162

United States Patent [19]

Wild

[11] 4,114,162

[45] Sep. 12, 1978

[54] GEODESIC LENS

[75] Inventor: John Paul Wild, Strathfield, Australia

[73] Assignee: Commonwealth Scientific and Industrial Research Organization, Campbell, Australia

[21] Appl. No.: 753,383

[22] Filed: Dec. 22, 1976

[30] Foreign Application Priority Data

Dec. 24, 1975 [AU] Australia ..... PC4390

[51] Int. Cl.[2] ..... H01Q 19/06; H01Q 15/02; H01Q 15/24

[52] U.S. Cl. ..... 343/754; 343/909

[58] Field of Search ..... 343/754, 755, 909

[56] References Cited

U.S. PATENT DOCUMENTS

| | | | |
|---|---|---|---|
| 3,071,768 | 1/1963 | Dunbar | 343/754 |
| 3,170,158 | 2/1965 | Rotman | 343/754 |
| 3,343,171 | 9/1967 | Goodman | 343/754 |
| 3,755,815 | 8/1973 | Stangel et al. | 343/754 |
| 3,958,246 | 5/1976 | Wohlers et al. | 343/754 |

*Primary Examiner*—Alfred E. Smith
*Assistant Examiner*—Harry Barlow
*Attorney, Agent, or Firm*—Sughrue, Rothwell, Mion, Zinn and Macpeak

[57] ABSTRACT

A geodesic lens parallel plate waveguide in the shape of a quarter-sphere is used to interconnect a linear array of transmitting/receiving elements and an array of coupling elements. Using this aerial component, scanned radio beams can be generated by a transmitting aerial if the array of coupling elements is commutatively actuated. Unused corners of the geodesic lens parallel plate waveguide may be omitted.

7 Claims, 7 Drawing Figures

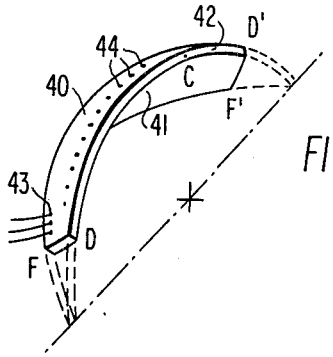
FIG. 4
FIG. 5
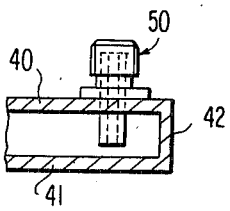
FIG. 6
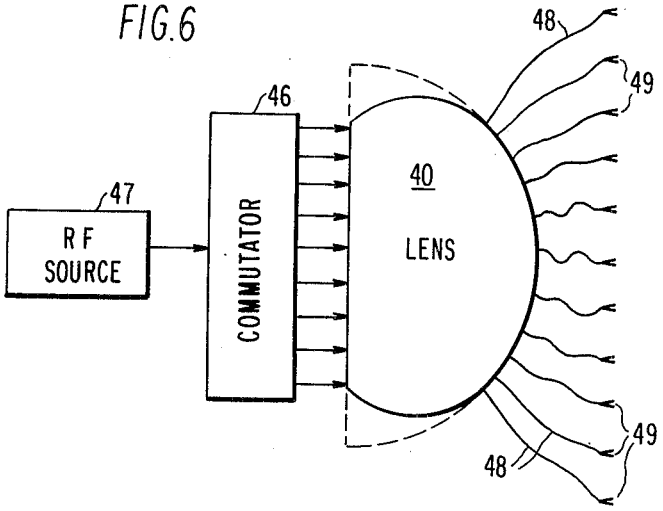

GEODESIC LENS

This invention concerns a geodesic lens for use in radio frequency aerials, for example, in the arrangement connecting power to a linear array of radio frequency transmitting elements for the generation of scanned radio beams. The invention, however, is not limited to this application — it could be used in the generation of other signals in space, or in corresponding receiving systems and radars.

The principle of applying a linear phase gradient to a linear array of radio frequency feed elements to generate a radio beam in a particular direction, and varying the phase gradient to vary the direction of propagation of the radio beam, is well known. But the conventional equipment required to continuously vary the linear phase gradient along the linear array, and thus generate a scanned radio beam, is both complex and expensive.

An object of the present invention, insofar as it relates to transmitting scanning beam aerials, is the provision of an aerial component for the feed system of a lens-fed antenna, which enables a linear or substantially linear phase gradient of signals applied to the transmitting elements of a radio frequency linear array to be continuously varied, when the RF power supply is a commutatively switched array of RF feed elements.

Basically, this objective is achieved by a geodesic lens which is a parallel plate waveguide connecting the commutatively switched feed elements to the transmitting elements of the linear array, the parallel plate waveguide having essentially the shape of a quarter-sphere.

Thus, according to the present invention, an R.F. aerial system component for use in interconnecting an array of RF coupling elements and a linear array of R.F. transmitting and/or receiving elements comprises a geodesic lens consisting of a parallel plate waveguide in the shape of a quarter sphere, one of the curved edges of the lens being adapted to be connected to the linear array, the other curved edge of the lens containing or being adapted to be connected to the array of coupling elements.

In its application to an aerial used to generate scanned radio beams, the interconnection is between an array of RF probes (input probes) adapted to be commutatively activated, typically by a switching arrangement which directs and modulates power from a single RF power source to the probes, and a linear array of column radiators connected by equal length RF cables to an arcuate array of RF probes mounted on the curved edge of the lens opposite the input-probes. Coupling elements other than probes (for example, slots formed in the parallel plate waveguide, or loops) may be used where appropriate.

In aerial structures where portions of the lens which are adjacent the right-angled corners of the quarter-sphere are not used for the transmission of RF energy, the geodesic lens may be made more compact by removing those portions.

The space between the parallel plates may be filled with a dielectric material.

An explanation of the way in which the present invention operates will now be given with reference to the accompanying drawings, of which:

Figure 3:
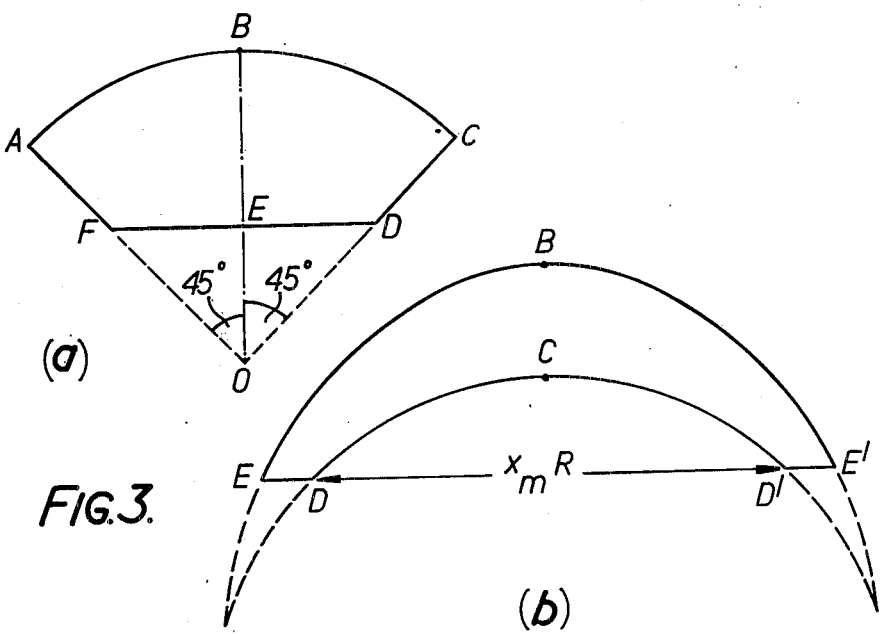

FIGS. 3(*a*) and 3(*b*) are side and end elevations, respectively, of a trimmed geodesic lens, FIG. 4 illustrates, in perspective an outline of an embodiment of the present invention, FIG. 5 is a sectional view detailing the construction of the input and output probes used in the embodiment of FIG. 4, and FIG. 6 is a schematic view of the lens of FIG. 4 connected to an RF input source and to an array of radiating elements.

Figure 1:
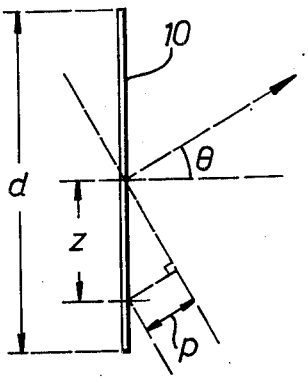
FIG. 1 depicts a linear array of radio frequency transmitting elements.

Referring to FIG. 1, a radio beam will be transmitted from the linear array of transmitting elements 10, of aperture *d*, at an angle $\theta$ from the normal to the array if the element located a distance $z$ from the centre of the array is given a phase increase of $2\pi z (\sin\theta)/\lambda$ ($\lambda$ being the wavelength of the radiation). If $z = kx$ and $\sin\theta = y/k$ (the choice of $k$ being arbitrary and one of convenience), then the additional path length, P, is given by $$P = z.\sin\theta = xy. \tag{1}$$

If the beam is to scan over an angle $\pm\theta_o$, then the maximum value of P is $P_{max} = (d/2)\sin\theta_o$, and P varies in the range-$P_{max} \leqq P \leqq P_{max}$.

Figure 2:
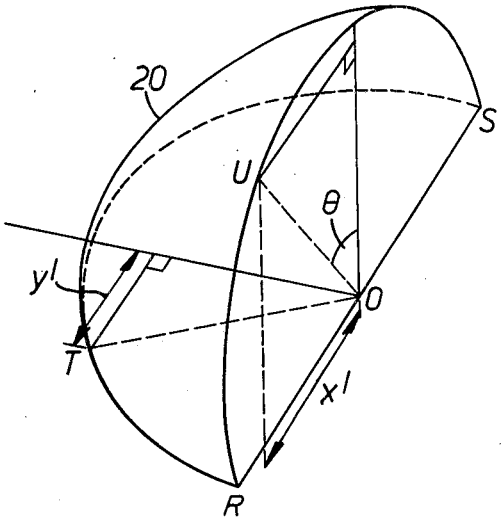
FIG. 2 shows a quarter-sphere geodesic lens surface.

In the case of the quarter-sphere parallel plate geodesic lens 20 depicted in FIG. 2, the input region, which is the curved edge containing the point T, is connected to a source of microwave power through input probes (not shown) located along the central region of edge RTS. Power to the input probes is commutatively switched, for example as recited in the specifications of Australian patent applications Nos. 14777/76, 14,779/76 and 20,002/76. The other curved edge RUS of the parallel plate lens is connected via output probes (not shown) located along the central portion of the edge RUS, through respective power cables of equal length, to the transmitting elements of a linear array. The extent to which the input and output probes approach the corners of the lens depends on the coverage angle of the scanning beam.

Using the nomenclature of FIG. 2, it will be clear from trigonometrical consideration of the right-angled spherical triangle TUR, that the great circle path from T to U, expressed in angle measure, differs from $\pi/2$ by an amount P', given by $$\begin{aligned} P' &= \sin^{-1}(x'\,y') \\ &= x'\,y' + \frac{(x'\,y')^3}{6} + \ldots \end{aligned} \tag{2}$$

where $x' = \sin\phi$ $y' = \sin\theta$

It will be noted that this expression is similar to that for P given in equation (1) above. Thus the surface acts as a lens of the required type with the higher order terms expressing the aberration of the lens.

Various methods of reducing this aberration are available. One is complex modulation of the feed system (see the specification of Australian patent application No. 14,777/76). Another method for reducing the aberration, however, is to perform a transformation in $x'$ and $y'$ by positioning the connections at T and U such that the output and input parameters $x$ and $y$ are not identical with $x'$ and $y'$ but are (odd) functions of them, i.e. equations of the general form $$x' = \alpha x + \beta x^3 + \gamma x^5 + \ldots$$

and $$y' = \alpha y + \beta y^3 + \gamma y^5 \ldots \quad (3)$$

By way of example only, one approach of this nature — one which leads to simple definitive equations in its solution — will be described below.

It will be noted by those skilled in this art that the aberration term $(x'y')^3/6$, plotted in the $x'y'$ plane, has a maximum ridge along the $x' = \pm y'$ directions, and one approach to reduce aberration is to suppress this ridge. This can be achieved by choosing $$x' = (x - \frac{x^5}{12})$$

and $$y' = (y - \frac{y^5}{12})$$

The aberration, ΔP, will then be given by $$\Delta P = P' - xy$$

$$= \sin^{-1}\{(x - cx^5)(y - cy^5)\} - xy$$

with the constant $c = 1/12$. An empirical approach, varying the value of $c$ around 1/12, can then be used to reduce the aberration still further. By doing this, it has been found that $c = 0.077$ is one improved value, in which case the aberration, $|\Delta P|$, is a maximum when $x \simeq 0.422y$, at which value $$(-\Delta P)_{max} \simeq 0.021y^5 \quad (4)$$

For other values of c, the constant of equation (4) will be given by evaluating the expression $$\{\frac{\frac{1}{2} - (\frac{1}{4} - 20.c^2)^{\frac{1}{2}}}{10.c}\}^{\frac{1}{2}} \quad (5)$$

If it is accepted that $|\Delta P_{max}|$ may be up to λ/16, then (using the subscript $m$ to denote the maximum value of a quantity allowed by aberration, and the subscript λ to denote that a length is measured in terms of wavelengths) for a lens capable of operating in the domain $|x| < x_m$ and $|y| < y_m$:

$$|\Delta P_{m\lambda}| = 0.021\, x_m^6 . R_\lambda = 1/16 \quad (6)$$

But, to the first order, $$P_{m\lambda} = x_m^2 . R_\lambda = (d_\lambda/2).\sin\theta_0 \quad (7)$$

Equations (6) and (7) can be used to obtain the largest allowable value of $x_m$ and the smallest allowable value of the radius of the sphere of the lens, $R_\lambda$, for given values of $d_\lambda.\sin\theta_0$, namely $$x_m = 1.56(d_\lambda.\sin\theta_0)^{-\frac{1}{2}} \quad (8)$$

$$R_\lambda = 0.205(d_\lambda.\sin\theta_0)^{3/2} \quad (9)$$

As noted above, the lens can be trimmed to remove those corner areas of the parallel plate transmission line which are not used; the lens then assumes the shape depicted in FIG. 3, with the extreme dimensions:

$$EE' = \sqrt{R_\lambda^2 - (R_\lambda - Z_\lambda)^2} = \sqrt{2} \cdot R_\lambda (1 + x_m^2)^{\frac{1}{2}}$$

$$AC = \sqrt{2R_\lambda}$$

$$EB = R_\lambda\left(1 - \frac{(1 - x_m^2)^{\frac{1}{2}}}{2}\right)$$

Typical examples of lens parameters are given in the following table:

| | | | Dimensions in λ's | | | |
|---|---|---|---|---|---|---|
| $d_\lambda$ | $\theta_o$ | $x_m$ | $R_\lambda$ | $X_\lambda$ | $Y_\lambda$ | $Z_\lambda$ |
| 140 | ±4° | .88 | 6.26 | 11.80 | 8.85 | 4.16 |
| 70 | ±10° | .84 | 8.69 | 16.01 | 12.29 | 5.36 |
| 70 | ±20° | .71 | 24.01 | 41.56 | 33.96 | 12.05 |
| 70 | ±30° | .64 | 42.45 | 71.32 | 60.08 | 19.41 |
| 70 | ±40° | .60 | 61.87 | 102.15 | 87.50 | 26.87 |

The approach detailed above, however, is by no means the only way in which the aberration can be reduced. Indeed, better reduction of aberration has been achieved using the general transformations of equation (3) with the constant α having a value slightly greater than unity and β being negative and small. The advantage of the '$x^5$' example is that, as mentioned earlier, it leads to relatively simple definitive equations as a solution to the reduction of aberration.

FIG. 4 illustrates a geodesic lens of the type described above, with the corners of the quarter sphere trimmed so that it had the dimensions R = 440 mm
EE' = 819 mm
AC = 622 mm
EB = 280 mm.

This lens was constructed by casting two aluminum plates 40,41 of the necessary shape, but slightly larger than the dimensions given above, machining each plate unitl it was about 10 mm thick, and spacing them apart 15 mm using two aluminum closure strips 42 located just outisde the imaginary edges FAF' and DCD', respectively (only the strip closing edge DCD' is shown in FIG. 4). Eighteen input probes 43 were mounted in appropriately dimensioned apertures in aluminum plate 40 to form an arcuate array of probes along the line FAF', and forty-five output probes 44 were located in a similar arc along the line DCD'. The input probes 43 were connected by equal length RF cables to a commutator 46 of known design, which distributed the power from RF source 47 to each probe sequentially and in accordance with a predetermined modulation. The output probes were connected via equal length RF cables 48 to respective ones of a linear array of radiating elements 49. Connection to each input and output probe was through a conventional RF connector 50, mounted atop the probe, as shown in FIG. 5. With the RF source 47 and commutator 46 operating, scanning radio beams were produced from the array of radiators 49. The phase gradients measured along the output arc when various input probes 43 were excited at a frequency of 5.06 GHz were found to agree closely with those calculated from the formulae presented earlier. However, the measurements suggested that an even closer agreement might be obtained by displacing the probes slightly off the great circles DCD′ and FAF′. This effect is presumed to be due to a displacement of the phase centres of the coupling elements (probes) away from their physical centres.

Also observed was a secondary refocussing of some of 40, 41 energy applied to one input probe into another input probe symmetrically placed with respect to until excited probe. The 10 energy represented energy not absorbed in 15 output arc. Such refocussed energy, if not wholly absorbed outside the input arc, might be expected to generate a secondary "ghost beam" in the array. However, a procedure has been developed for matching the input and output probes over the aluminium of angles of incidence encountered in the lens, to such a degree that the ghost beam will be at least 30 dB below the main beam.

I claim:

1. An RF aerial system component for use in interconnecting an arcuate array of RF coupling elements and a linear array of RF transmitting and/or receiving elements comprising a geodesic lens consisting of a parallel plate waveguide in the shape of a quarter sphere, one curved edge of the lens being adapted to be connected to the linear array, the other curved edge of the lens containing or being adapted to be connected to the arcuate array of RF coupling elements.

2. An RF aerial system component as defined in claim 1, in which the elements of the linear array are coupled to an arcuate array of RF coupling elements mounted closely adjacent said one curved edge.

3. An RF aerial system component as defined in claim 2, in which each array of RF coupling elements is an array of RF probes and the coupling to the linear array is effected with RF cables of equal length.

4. An RF aerial system component as defined in claim 3, in which each array of RF probes is mounted closely adjacent to its respective curved edge.

5. An RF aerial system component as defined in claim 3, in which the RF probes comprising the first-mentioned RF coupling elements are connected to a single RF power source via a switching and modulating circuit arrangement adapted to commutatively excite said RF probes, whereby said aerial system generates scanned radio beams.

6. An RF aerial system as defined in claim 3, in which said arcuate arrays of RF probes extend over a part only of their respective curved edges, and portions of the geodesic lens which are adjacent the right-angled corners of the quarter-sphere and which are not required for power transmission between said arcuate arrays of RF probes are absent from the lens.

7. An RF aerial system component as defined in claim 3, in which the space between the parallel plates of the geodesic lens is filled with a dielectric material.

* * * * *